US007431418B2

(12) United States Patent
Huang

(10) Patent No.: US 7,431,418 B2
(45) Date of Patent: Oct. 7, 2008

(54) INK BOX DETECTION SYSTEM AND METHOD THEREOF

(75) Inventor: Chien-Chih Huang, Taoyuan (TW)

(73) Assignee: Qisda Corporation (TW)

( * ) Notice: Subject to any disclaimer, the term of this patent is extended or adjusted under 35 U.S.C. 154(b) by 431 days.

(21) Appl. No.: 11/186,655

(22) Filed: Jul. 20, 2005

(65) Prior Publication Data

US 2006/0017756 A1 Jan. 26, 2006

(30) Foreign Application Priority Data

Jul. 21, 2004 (TW) ..... 93121745 A

(51) Int. Cl.
*B41J 29/393* (2006.01)

(52) U.S. Cl. ..... 347/19; 347/85

(58) Field of Classification Search ..... 347/19
See application file for complete search history.

(56) References Cited

U.S. PATENT DOCUMENTS 6,161,915 A 12/2000 Bolash et al. ..... 347/19
6,263,170 B1 7/2001 Bortnem
6,407,557 B1 6/2002 Coudray et al.
6,650,847 B2 * 11/2003 Guy et al. ..... 399/12
7,289,133 B1 * 10/2007 Friedrich et al. ..... 347/112

* cited by examiner

*Primary Examiner*—Matthew Luu
*Assistant Examiner*—Brian J Goldberg
(74) *Attorney, Agent, or Firm*—Birch, Stewart, Kolasch & Birch, LLP.

(57) ABSTRACT

An ink box detection system and method thereof are provided for detecting an ink box installed in an ink jet apparatus. The ink box has an identification circuit to generate a reference voltage. The detection system includes a voltage divider resistance with a power supply, a connector for connecting the identification circuit of the ink box and the voltage divider resistance with the power supply, a voltage supplier, a voltage detector connected to the connector and the voltage supplier, and a controller connected to the voltage supplier and the voltage detector. The voltage supplier provides an adjustable voltage that is adjusted by an adjustable digital signal from the controller. The voltage detector includes a single comparator for comparing the adjustable voltage with the reference voltage. When the adjustable voltage is the same as the reference voltage, a detection signal is outputted to the controller to identify the ink box.

3 Claims, 7 Drawing Sheets

INK BOX DETECTION SYSTEM AND METHOD THEREOF

BACKGROUND OF THE INVENTION

1. Field of the Invention

The present invention relates to an ink box detection system and method thereof, especially to an ink box detection system and method thereof for detecting the kind of an ink box installed in an ink jet apparatus.

2. Description of the Prior Art

There are usually many kinds of ink boxes installed in an ink jet apparatus for providing various qualities and speeds for ink jet print. When an ink box is installed, the ink jet apparatus has to detect the kind of the ink box to make correct setting.

The ink jet apparatus of the prior art utilizes the resistance of an ink box to identify the kind of the ink box. Because different ink box has different resistance respectively, a reference voltage will be generated by a voltage divider when the ink box is installed in the ink jet apparatus. The ink jet apparatus utilizes a plurality of comparators to generate a plurality of corresponding voltage intervals and detects that the reference voltage generated from the ink box belongs to which voltage interval, so as to identify the kind of the ink box. By this way, if the prior art wants to detect various ink boxes in the ink jet apparatus, it will need more comparators, such that the cost of the ink jet apparatus is increased and the circuit is more complicated.

Accordingly, the objective of the present invention is to provide an ink box detection system and method thereof for simplifying the complicated circuit and reducing the cost.

SUMMARY OF THE INVENTION

The objective of the present invention is to provide an ink box detection system and method thereof, especially to an ink box detection system and method thereof utilizing a single comparator to detect the kind of the ink box, so as to simplify the complicated circuit and reduce the cost.

In an embodiment, the present invention provides an ink box detection system for detecting an ink box installed in an ink jet apparatus. The ink box has an identification circuit. The ink box detection system includes a voltage divider resistance, a power supply, an ink box connector, a voltage supplier, a voltage detector, and a controller. One end of the ink box connector is connected to the identification circuit of the ink box, and the other end of the ink box connector is connected to the voltage divider resistance and the power supply. The voltage supplier is used for providing an adjustable voltage. The voltage detector is connected to the ink box connector and the voltage supplier. The voltage detector includes a single comparator for comparing a reference voltage generated by the identification circuit with the adjustable voltage. The voltage detector further outputs a detection signal when the reference voltage is the same with the adjustable voltage. The controller is connected to the voltage supplier and the voltage detector and is used for outputting an adjustable digital signal to the voltage supplier to adjust the adjustable voltage. The controller further receives the detection signal from the voltage detector to identify the kind of the ink box. Moreover, the adjustable digital signal is a pulse width modulation (PWM) signal with a fixed frequency. The controller adjusts the adjustable voltage of the voltage supplier by controlling the duty cycle of the PWM signal.

Compared to the prior art, the ink box detection system of the present invention utilizes a single comparator to identify the kind of the ink box, so the present invention can reduce the cost and simplify the circuit. Furthermore, if the scale of the adjustable voltage is smaller, the comparable reference voltage will be more. In other words, more kinds of ink boxes can be detected.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
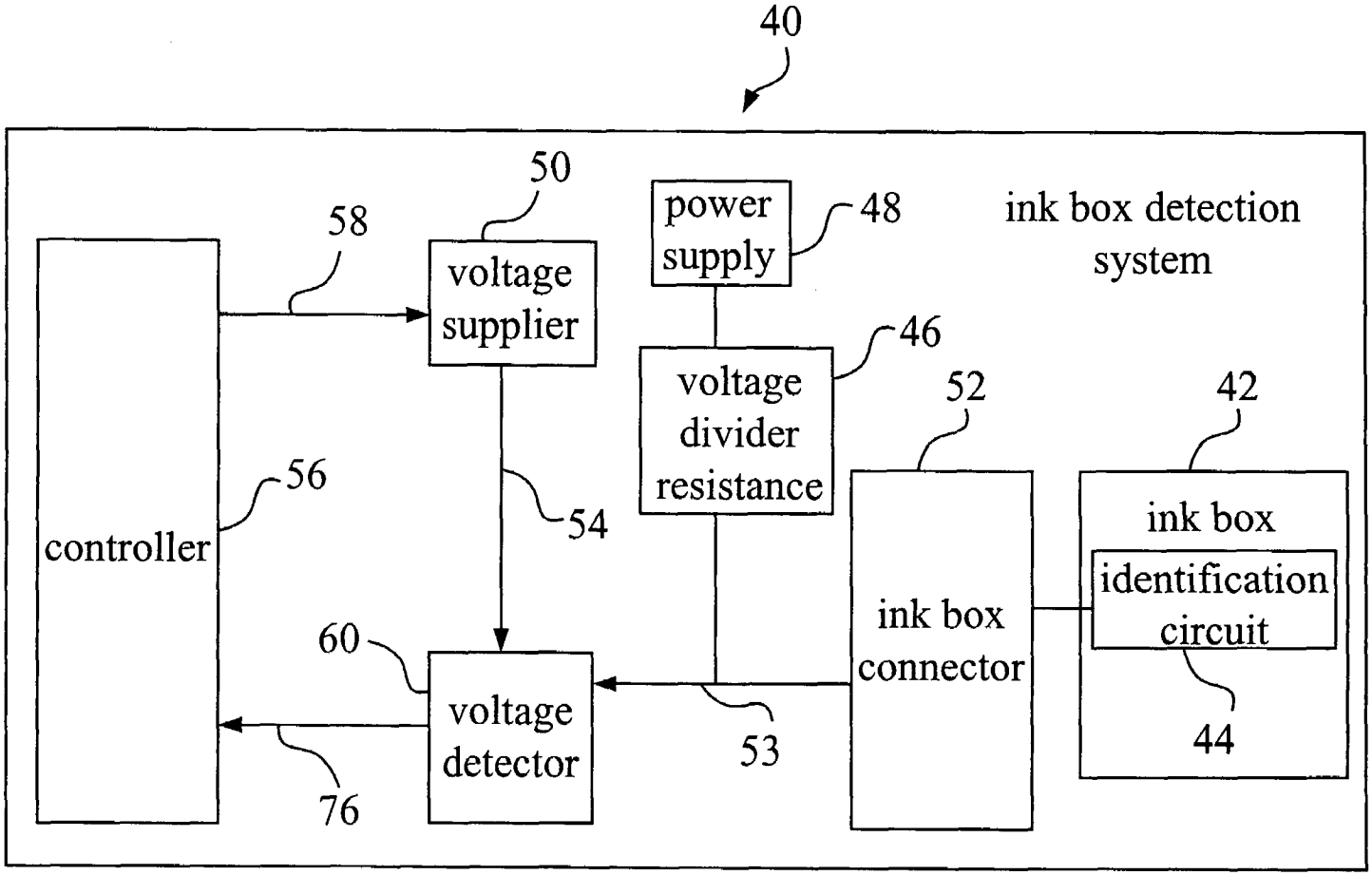
FIG. 1 is a schematic diagram of an ink box detection system according to the present invention.
Figure 2:
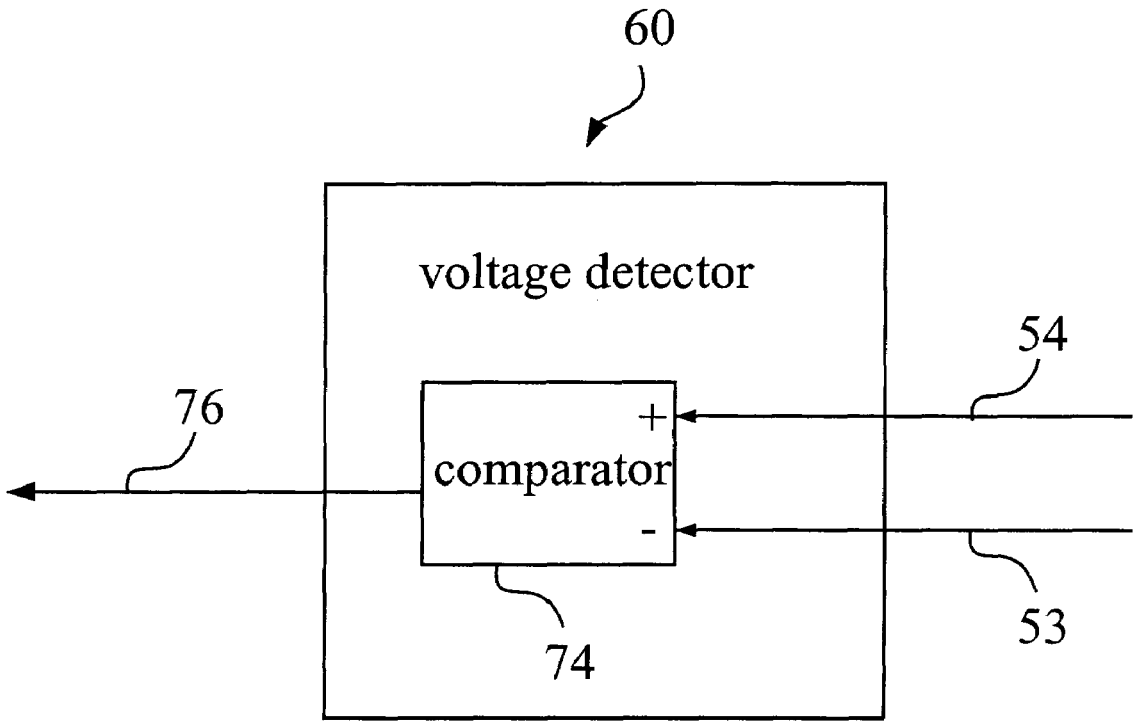
FIG. 2 is a schematic diagram of the voltage detector shown in FIG. 1.

Referring to FIG. 1 and FIG. 2, FIG. 1 is a schematic diagram of an ink box detection system 40 according to the present invention. FIG. 2 is a schematic diagram of the voltage detector 60 shown in FIG. 1. As shown in FIG. 1, the ink box detection system 40 is used for detecting an ink box 42 installed in an ink jet apparatus (not shown). The ink box 42 has an identification circuit 44. The ink box detection system 40 includes a voltage divider resistance 46, a power supply 48, an ink box connector 52, a voltage supplier 50, a voltage detector 60, and a controller 56.

As shown in FIG. 1, one end of the ink box connector 52 is connected to the identification circuit 44 of the ink box 42, and the other end of the ink box connector 52 is connected to the voltage divider resistance 46 and the power supply 48. The voltage supplier 50 is used for providing an adjustable voltage 54. The voltage detector 60 is connected to the ink box connector 52 and the voltage supplier 50 for outputting a detection signal 76. The controller 56 is connected to the voltage supplier 50 and the voltage detector 54 for outputting an adjustable digital signal 58 to the voltage supplier 50 to adjust the adjustable voltage 54 and receiving the detection signal 76 from the voltage detector 60 to identify the kind of the ink box 42. The adjustable digital signal 58 is a pulse width modulation (PWM) signal with a fixed frequency. The controller 56 adjusts the adjustable voltage 54 of the voltage supplier 50 by controlling the duty cycle of the PWM signal.

As shown in FIG. 2, the voltage detector 60 includes a single comparator 74 for comparing a reference voltage 53 generated by the identification circuit 44 with the adjustable voltage 54 provided by the voltage supplier 50. When the comparator 74 receives the reference voltage 53 and the adjustable voltage 54 and further compares the reference voltage 53 with the adjustable voltage 54, the controller 56 will adjust the adjustable voltage 54 of the voltage supplier 50, and then the adjustable voltage 54 will increase or decrease gradually. When the adjustable voltage 54 is lower than the reference voltage 53, the controller 56 will adjust the adjustable voltage 54 of the voltage supplier 50 to increase gradually. When the adjustable voltage 54 is higher than the reference voltage 53, the controller 56 will adjust the adjustable voltage 54 of the voltage supplier 50 to decrease gradually. When the reference voltage 53 is the same as the adjustable voltage 54, the comparator 74 outputs the detection signal 76. After that, the controller 56 receives the detection signal 76 from the voltage detector 60 to identify the kind of the ink box 42.

Figure 3A:
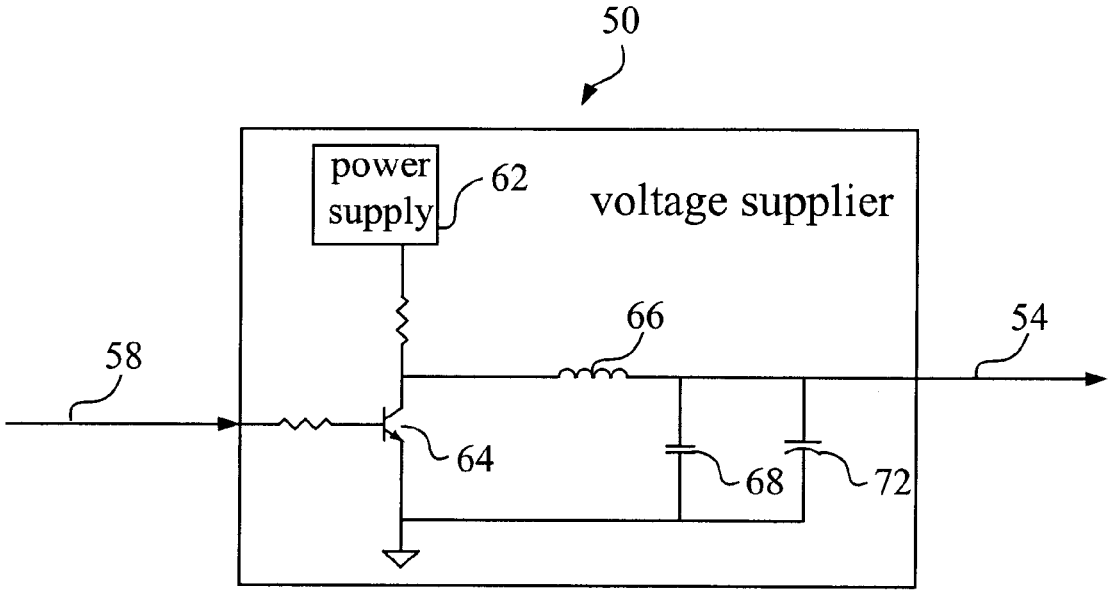
FIG. 3A is a schematic diagram of the voltage supplier shown in FIG. 1.
Figure 3B:
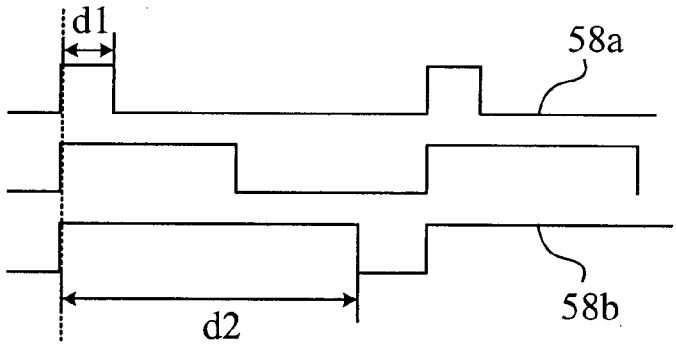
FIG. 3B is a schematic diagram of three different duty cycles of the adjustable digital signal shown in FIG. 3A.

Referring to FIG. 3A and FIG. 3B, FIG. 3A is a schematic diagram of the voltage supplier 50 shown in FIG. 1. FIG. 3B is a schematic diagram of three different duty cycles of the adjustable digital signal 58 shown in FIG. 3A. As shown in FIG. 3A, the voltage supplier 50 includes a power supply 62, a transistor 64, an inductance 66, and two capacitances 68 and 72. The adjustable voltage 54 outputted by the voltage supplier 50 is controlled by the adjustable digital signal 58 of the controller 56. The controller 56 adjusts the duty cycle of the adjustable digital signal 58 to control the voltage to increase or decrease.

FIG. 3B shows the adjustable digital signal with three different duty cycles. The above-mentioned adjustable digital signal is a PWM signal with a fixed frequency. When the PWM signal maintains high frequency with a longer period of time, the duty cycle of the PWM signal is larger. As shown in FIG. 3B, the duty cycle (d1) of the adjustable digital signal 58*a* is shorter, and the duty cycle (d2) of the adjustable digital signal 58*b* is larger. When the adjustable digital signal 58*a* with shorter duty cycle (d1) is inputted into the voltage supplier 50 via the controller 56, the transistor 64 is switched off and the power supply 62 charges the inductance 66 and the capacitances 68 and 72, so as to increase the voltage. In other words, when the duty cycle is shorter, the voltage is higher. When the adjustable digital signal 58*b* with larger duty cycle (d2) is inputted into the voltage supplier 50 via the controller 56, the transistor 64 is switched on and the power supply 62 discharges the inductance 66 and the capacitances 68 and 72, so as to decrease the voltage. In other words, when the duty cycle is larger, the voltage is lower. Accordingly, the controller 56 can adjust the adjustable voltage 54 of the voltage supplier 50 by controlling the duty cycle of the adjustable digital signal 58.

Figure 4:
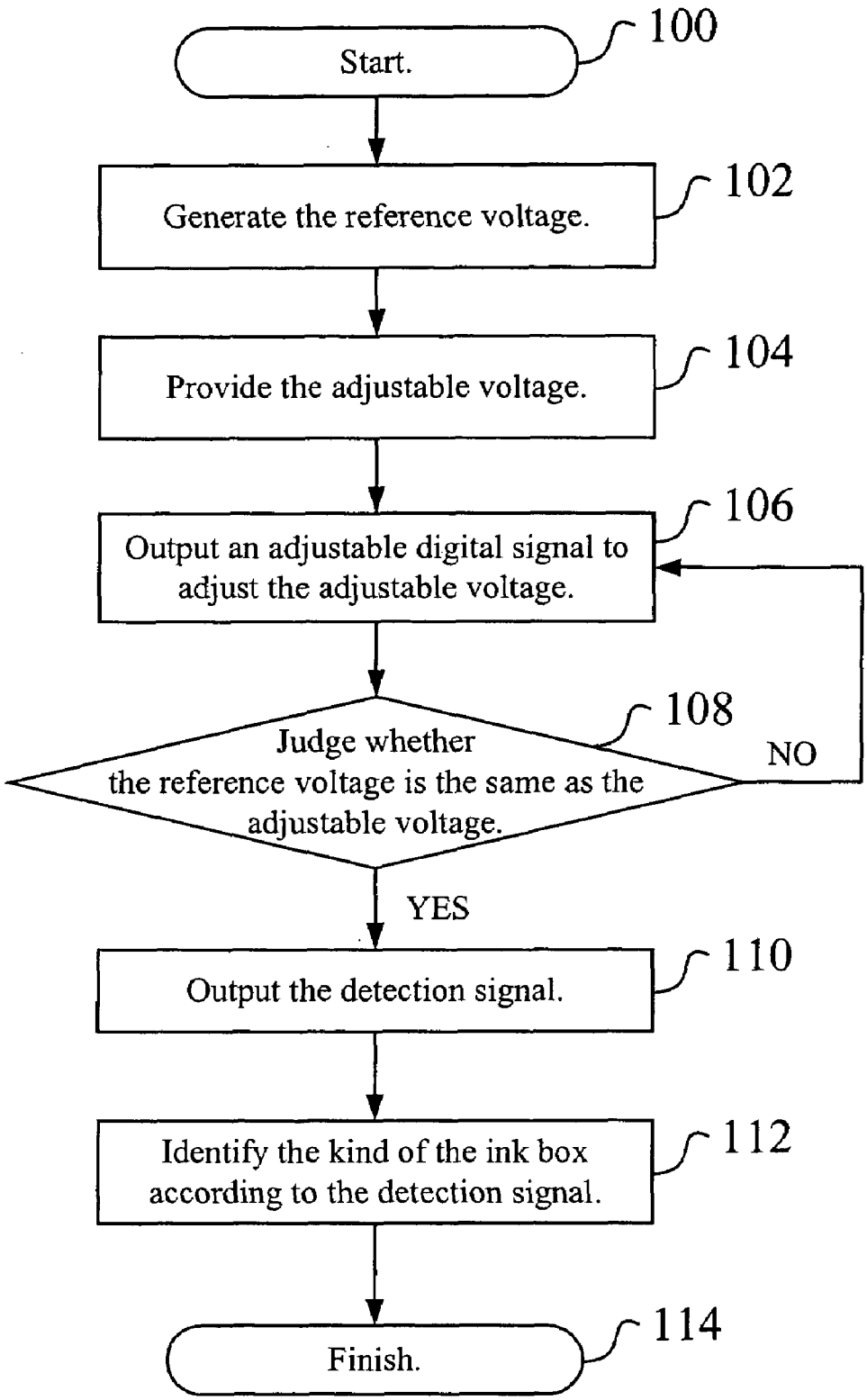
FIG. 4 is a flowchart of the ink box detection method of the ink box detection system shown in FIG. 1.

Referring to FIG. 4, FIG. 4 is a flowchart of the ink box detection method of the ink box detection system 40 shown in FIG. 1. The present invention provides an ink box detection method for detecting an ink box installed in an ink jet apparatus. The following utilizes the ink box detection system 40 to describe the ink box detection method. The ink box detection method of the present invention includes the following steps:

Step 100: Start.

Step 102: Generate the reference voltage 53.

Step 104: Provide the adjustable voltage 54.

Step 106: Output an adjustable digital signal 58 to adjust the adjustable voltage 54.

Step 108: Judge whether the reference voltage 53 is the same as the adjustable voltage 54. If it is a YES, go to step 110, otherwise go back to step 106 to adjust the adjustable voltage 54 again.

Step 110: Output the detection signal 76.

Step 112: Identify the kind of the ink box 42 according to the detection signal 76.

Step 114: Finish.

Compared to the prior art, the ink box detection system 40 of the present invention adjusts the adjustable voltage 54 and compares the adjustable voltage 54 with the reference voltage 53 to output the detection signal to identify the kind of the ink box when the adjustable voltage 54 is the same as the reference voltage 53. Therefore, the ink box detection system of the present invention utilizes a single comparator 74 to identify the kind of the ink box, so the present invention can reduce the cost and simplify the circuit. Furthermore, if the scale of the adjustable voltage is smaller, the comparable reference voltage will be more. In other words, more kinds of ink boxes can be detected.

Figure 5:
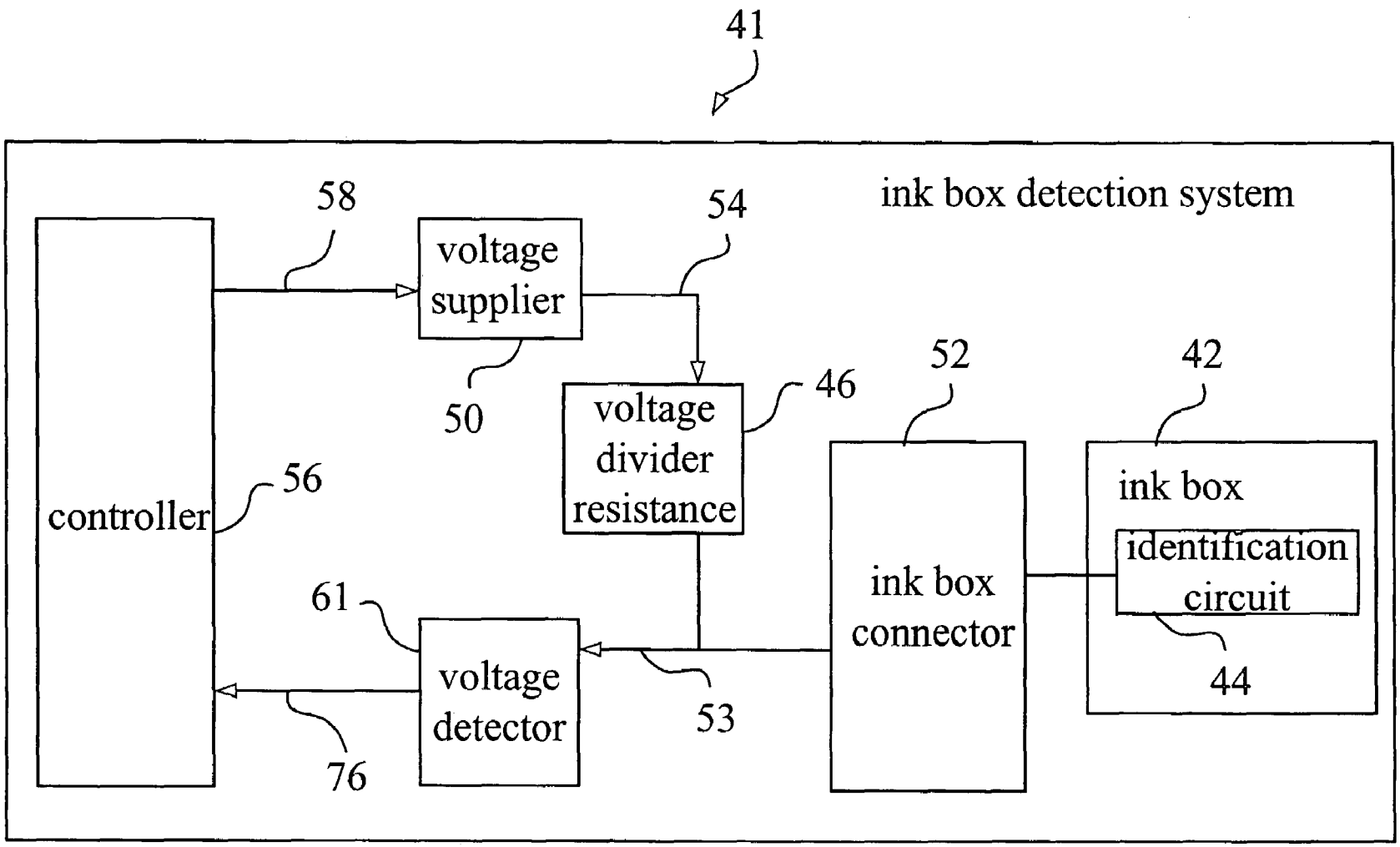
FIG. 5 is a schematic diagram of an ink box detection system of another preferred embodiment according to the present invention.
Figure 6:
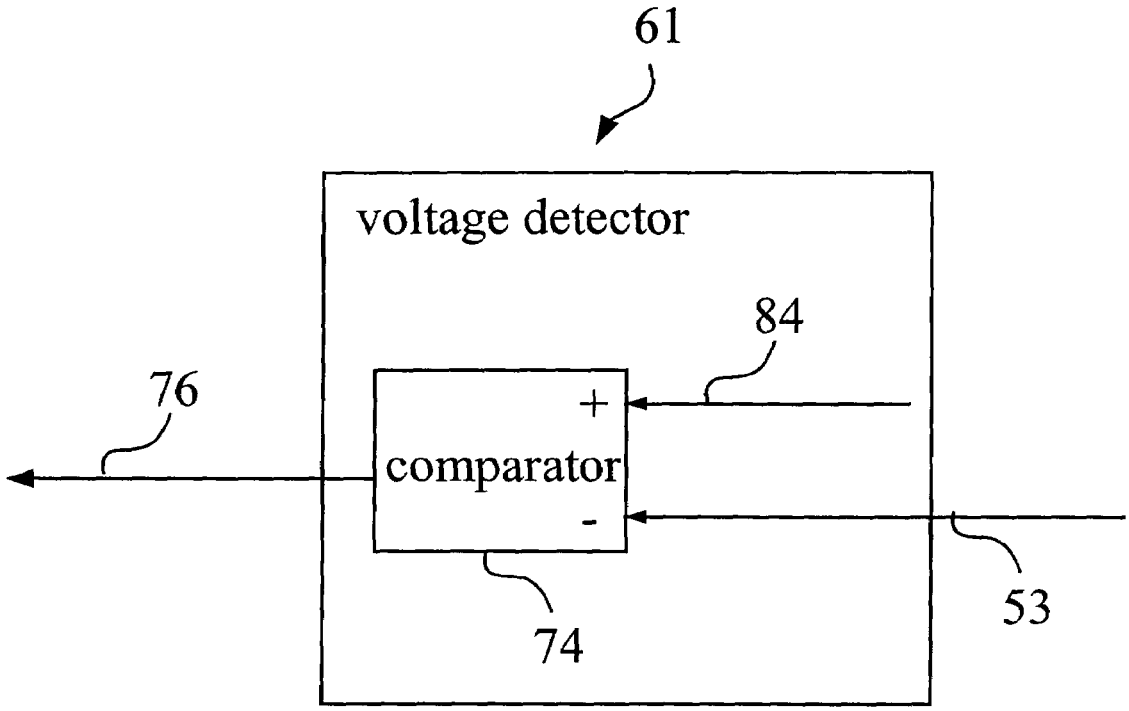
FIG. 6 is a schematic diagram of the voltage detector of the ink box detection system shown in FIG. 5.

Referring to FIG. 5 and FIG. 6, FIG. 5 is a schematic diagram of an ink box detection system 41 of another preferred embodiment according to the present invention. FIG. 6 is a schematic diagram of the voltage detector 61 of the ink box detection system 41 shown in FIG. 5. As shown in FIG. 5, the ink box detection system 41 is used for detecting an ink box 42 installed in an ink jet apparatus (not shown). The ink box 42 has an identification circuit 44 for generating a reference voltage 53. The ink box detection system 41 includes a voltage divider 46, an ink box connector 52, a voltage supplier 50, a voltage detector 61, and a controller 56. One end of the ink box connector 52 is connected to the identification circuit 44 of the ink box 42, and the other end of the ink box connector 52 is connected to the voltage divider resistance 46. The voltage supplier 50 is used for providing an adjustable voltage 54. The voltage detector 61 is connected to the ink box connector 52.

As shown in FIG. 6, the voltage detector 61 includes a single comparator 74. The comparator 74 can generate a predetermined reference voltage 84 for being compared with the reference voltage 53 generated by the identification circuit 44. The reference voltage 53 is calculated by the following equation:

$$Vref1 = \frac{Rref1 \times Vref2}{R1 + Rref1}$$

In the above equation, R1 represents the value of the voltage divider resistance 46, Rref1 represents the value of the resistance in the identification circuit 44, Vref1 represents the value of the reference voltage 53, and Vref2 represents the value of the adjustable voltage 54.

In the ink box detection system 41, the controller 56 is connected to the voltage supplier 50 and the voltage detector 54 for outputting an adjustable digital signal 58 to the voltage supplier 50 to adjust the adjustable voltage 54. The adjustable digital signal 58 is a PWM signal with a fixed frequency. The controller 56 adjusts the adjustable voltage 54 of the voltage supplier 50 by controlling the duty cycle of the PWM signal.

The controller 56 can adjust the adjustable voltage (Vref2) 54 of the voltage supplier 50 to increase or decrease gradually. As the above equation, when the adjustable voltage (Vref2) 54 increases, the reference voltage (Vref1) 53 will increase correspondingly. When the reference voltage 53 is lower than the predetermined reference voltage 84, the controller 56 will adjust the adjustable voltage (Vref2) 54 of the voltage supplier 50 to increase the reference voltage (Vref1) 53 gradually. When the reference voltage 53 is higher than the predetermined reference voltage 84, the controller 56 will adjust the adjustable voltage (Vref2) 54 of the voltage supplier 50 to decrease the reference voltage (Vref1) 53 gradually. When the reference voltage 53 is the same as the predetermined reference voltage 84, the comparator 74 will output a detection signal 76. The controller 56 receives the detection signal 76 from the voltage detector 60 to identify the kind of the ink box 42. The function and principle of the voltage supplier 50 of the ink box detection system 41 shown in FIG. 5 is the same as the voltage supplier 50 of the ink box detection system 40 shown in FIG. 1 and will not be described again.

In the ink box detection system 41 of the present invention, the reference voltage 53 is influenced by the adjustable voltage 54 to increase or decrease until the reference voltage 53 is the same as the predetermined reference voltage 84, and then the comparator 74 outputs the detection signal to identify the kind of the ink box. In other words, the ink box detection system 41 of the present invention only utilizes a single comparator 74 to identify the kind of the ink box.

Figure 7:
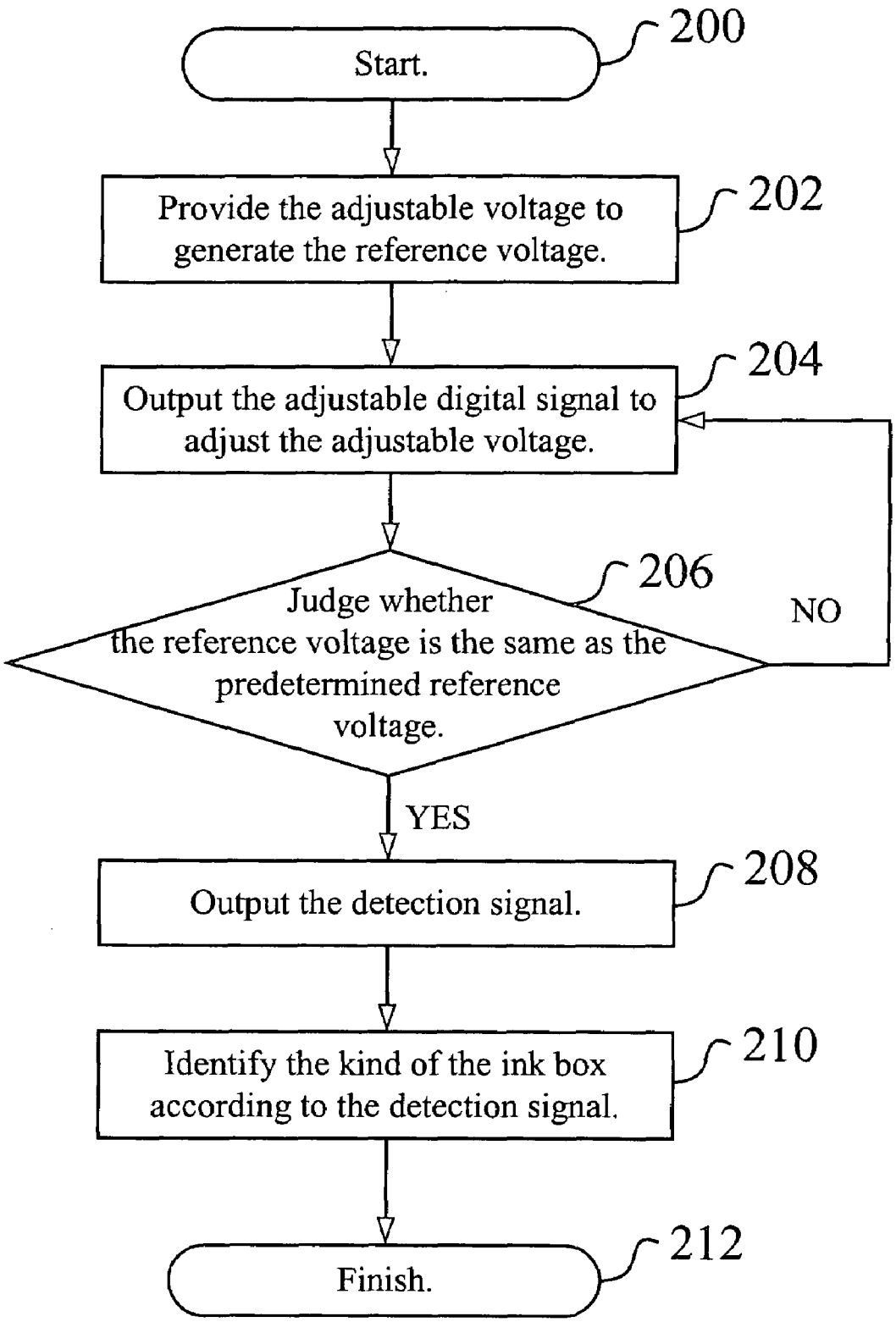
FIG. 7 is a flowchart of the ink box detection method of the ink box detection system shown in FIG. 5.

Referring to FIG. 7, FIG. 7 is a flowchart of the ink box detection method of the ink box detection system 41 shown in FIG. 5. The present invention provides an ink box detection method for detecting an ink box installed in an ink jet apparatus. The following utilizes the ink box detection system 41 to describe the ink box detection method. The ink box detection method of the present invention includes the following steps:

Step 200: Start.

Step 202: Provide the adjustable voltage 54 to generate the reference voltage 53.

Step 204: Output the adjustable digital signal 58 to adjust the adjustable voltage 54.

Step 206: Judge whether the reference voltage 53 is the same as the predetermined reference voltage 84. If it is a YES, go to step 208, otherwise go back to step 204 to adjust the adjustable voltage 54 again.

Step 208: Output the detection signal 76.

Step 210: Identify the kind of the ink box 42 according to the detection signal 76.

Step 212: Finish.

Compared to the prior art, the ink box detection system of the present invention utilizes a single comparator to identify the kind of the ink box, so the present invention can reduce the cost and simplify the circuit. Furthermore, if the scale of the adjustable voltage is smaller, the comparable reference voltage will be more. In other words, more kinds of ink boxes can be detected.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An ink box detection system for detecting an ink box installed in an ink jet apparatus, the ink box having an identification circuit, said ink box detection system comprising:

a voltage divider resistance and a power supply;

an ink box connector, one end of the ink box connector being connected to the identification circuit of the ink box, and the other end of the ink box connector being connected to the voltage divider resistance and the power supply;

a voltage supplier for providing an adjustable voltage;

a voltage detector, connected to the ink box connector and the voltage supplier, comprising a single comparator for comparing a reference voltage generated by the identification circuit with the adjustable voltage and outputting a detection signal when the reference voltage is the same with the adjustable voltage; and a controller connected to the voltage supplier and the voltage detector for outputting an adjustable digital signal to the voltage supplier to adjust the adjustable voltage and receiving the detection signal from the voltage detector to identify the kind of the ink box.

2. The ink box detection system of claim 1, wherein the adjustable digital signal outputted by the controller is a pulse width modulation (PWM) signal with a fixed frequency.

3. The ink box detection system of claim 2, wherein the controller adjusts the adjustable voltage of the voltage supplier by controlling the duty cycle of the PWM signal.

* * * * *